US007764244B1

(12) United States Patent
Sergi et al.

(10) Patent No.: US 7,764,244 B1
(45) Date of Patent: Jul. 27, 2010

(54) FEEDPOINT SUPPORT FOR CENTER FED DIPOLE ANTENNA

(75) Inventors: Paul D. Sergi, Peninsula, OH (US); Edward L. Merical, Canal Fulton, OH (US)

(73) Assignee: PDS Electronics, Inc., Akron, OH (US)

( * ) Notice: Subject to any disclaimer, the term of this patent is extended or adjusted under 35 U.S.C. 154(b) by 548 days.

(21) Appl. No.: 11/903,695

(22) Filed: Sep. 25, 2007

(51) Int. Cl.
*H01Q 9/16* (2006.01)
*H01Q 1/00* (2006.01)

(52) U.S. Cl. ..... 343/793; 343/905

(58) Field of Classification Search ..... 343/793, 343/878, 905
See application file for complete search history.

(56) References Cited

U.S. PATENT DOCUMENTS 7,116,281 B2 * 10/2006 Rankin ..... 343/820
7,427,964 B2 * 9/2008 Sergi ..... 343/793

OTHER PUBLICATIONS

"Insulators for wire antennas", one page, Feb. 2006.
"Ladder Line Center Insulator", Radioware & Radio Bookstore, one page, Feb. 2006.
"The Alternative Multi-Band Solution", Granite State Antenna, Northwood, New Hampshire, 1 page, Feb. 2006.
Drawings of U.S. Appl. No. 11/414,778, May 1, 2006.

* cited by examiner

*Primary Examiner*—Shih-Chao Chen
(74) *Attorney, Agent, or Firm*—Renner, Kenner, Greive, Bobak, Taylor & Weber

(57) ABSTRACT

An antenna includes a feedpoint support plate (10) which is provided with terminal connectors (27, 28) to attach feed wires (25, 26) to dipole lines (31, 32). A balun (33) of one size may be connected to the plate (10) by fastening assemblies (43, 44, 45) received at apertures (29, 30) in the plate (10) and at apertures (41) of the balun (33). Baluns of other sizes may also be connected to the plate (10) by fastening assemblies (64, 65, 66) received at apertures (62, 63) in the plate (10) and at holes (60, 61) provided with the coil (57). The plate (10) can also carry a strain relief bracket (70) which includes grip members (76) which engage the feed line (24) at two spaced locations with a loop (79) formed therebetween to isolate a coupling (34) from any strain.

19 Claims, 4 Drawing Sheets

FEEDPOINT SUPPORT FOR CENTER FED DIPOLE ANTENNA

TECHNICAL FIELD

This invention relates to a feedpoint support unit which can be universally used to carry a wide variety of items in a center fed dipole antenna. More particularly, the feedpoint support bracket can be provided with a wire strain relief feature.

BACKGROUND ART

The convenient assembly of center fed dipole antennas has long been a problem. Such is particularly the case when it may be desired to mount ladder lines, coax feeds, baluns, coils, or the like to the center feedpoint support. Moreover, care must be taken that the connections are maintained. However, most systems do not conveniently provide the strain relief required to maintain the connections.

DISCLOSURE OF THE INVENTION

It is thus an object of one aspect of the present invention to provide a center feedpoint support unit which is capable of carrying a wide variety of items.

It is an object of another aspect of the invention to provide a support unit, as above, with a strain relief system.

These and other objects of the present invention, as well as the advantages thereof over existing prior art forms, which will become apparent from the description to follow, are accomplished by the improvements hereinafter described and claimed.

In general, an antenna made in accordance with one aspect of the invention includes a feedpoint support plate and a feed line extending from a source and carried by the plate. A bracket is carried by the plate and the bracket carries a strain relief device between the source of the feed line and the plate. The strain relief device includes first and second grip members, the feed line being connected to each grip member with a loop formed in the feed line between the grip members.

In accordance with another aspect of the invention, an antenna includes a feedpoint support plate, means to carry a feed line on the plate, and means permitting connection between the feed line and dipole lines. Means are also provided for selectively carrying a balun on the plate between the feed line and the dipole lines.

An antenna in accordance with the invention may also include a feedpoint support plate and a feed line extending from a source to the plate. Means are provided to permit connection between the feed line and the dipole lines, and means are also provided for selectively carrying a balun on the plate between the feed line and the dipole lines. A bracket is carried by the plate, and the bracket carries a strain relief device between the source of the feed line and the plate. The strain relief device includes first and second grip members, the feed line being connected to each grip member with a loop formed in the feed line between the grip members.

A feedpoint support for an antenna made in accordance with the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
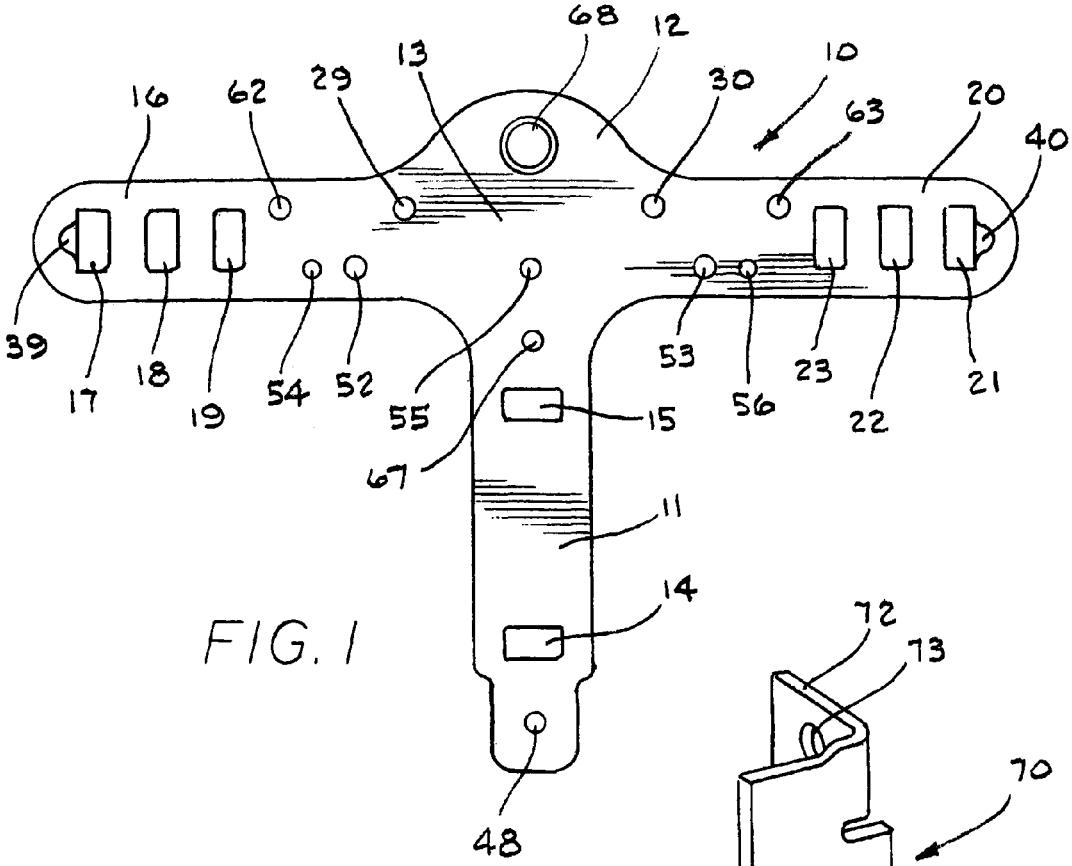
FIG. 1 is an elevational view of a feedpoint support unit made in accordance with the concepts of the present invention.
Figure 2:
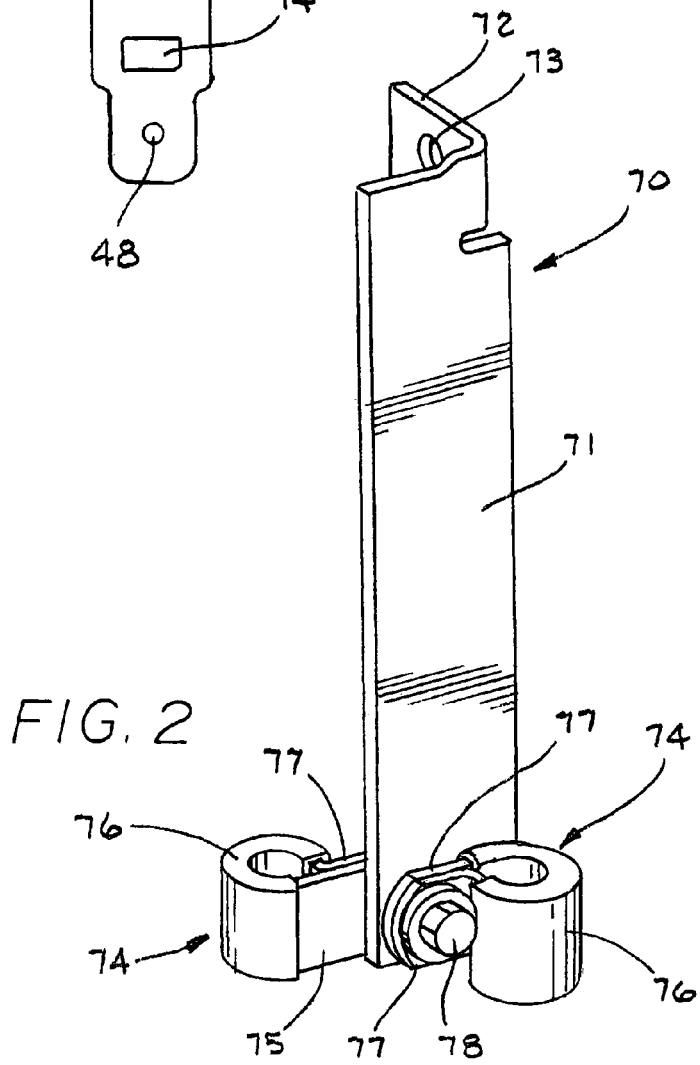
FIG. 2 is a perspective view of a strain relief bracket made in accordance with the concepts of the present invention.

A feedpoint support unit is generally indicated by the numeral 10 and is preferably formed of an insulating plastic or like material such as glass filled nylon. Support unit 10 is in the form of a plate of somewhat cross-shaped configuration. Thus, support unit 10 has an elongate base 11, a head 12, and a crossarm 13 between the base 11 and the head 12. Base 11 includes two spaced slots 14, 15 extending therethrough. End 16 of crossarm 13 is provided with spaced slots 17, 18, 19 extending therethrough, and likewise end 20 of crossarm 13 is provided with spaced slots 21, 22, 23 extending therethrough.

Figure 3:
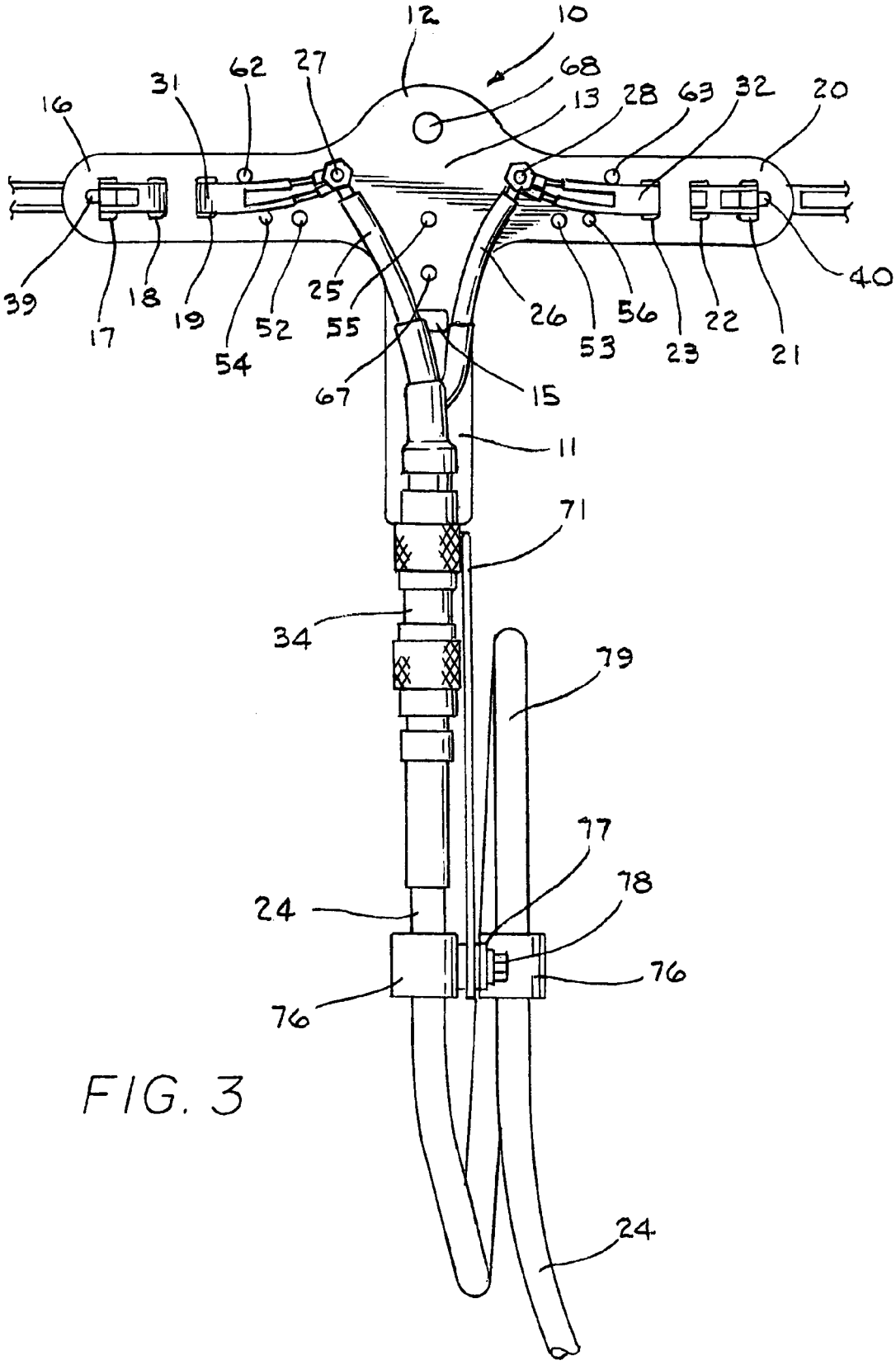
FIG. 3 is a depiction of a coax feed to a ladder line system carried by the feedpoint support unit with the coax being provided with strain relief.

If unit 10 is to be used with an antenna feed line in the form of a ladder line, for example, the ladder line would pass downwardly through slot 14 and then upwardly through slot 15 to provide strain relief for the feed wire. Alternatively, the feed line may be in the form of a coaxial cable 24 as shown in FIG. 3. In either event, the ladder line or the coaxial cable 24 can include feed wires 25 and 26 which extend from a source, and as shown in FIG. 3, are attached to terminal connections 27 and 28, respectively, carried by apertures 29 and 30, respectively, formed in crossarm 13 of unit 10. Terminal connectors 27 and 28 include, for example, a bolt, washer, and nut, or the like, and are intended to hold wires such that any wire held at a terminal electrically communicates with one or more other wires held by that terminal.

Thus, terminal 27 attaches the feed wires, such as wires 25 and 26, to dipole lines 31 and 32, respectively, which may be in the form of ladder lines as shown in FIG. 3. As shown there, line 31 extends downwardly through slot 19, upwardly through slot 18, and downwardly through slot 17 of support unit 10. Similarly, line 32 extends downwardly through slot 23, upwardly through slot 22, and downwardly through slot 21 of support unit 10. Such provides strain relief to lines 31 and 32 as they extend laterally outward to additional support brackets (not shown) which are part of the dipole antenna. For details regarding such an antenna and its components, reference is made to U.S. Publication No. 2006-0262025-A1 for whatever details are necessary in order to understand the environment of the present invention.

Figure 4:
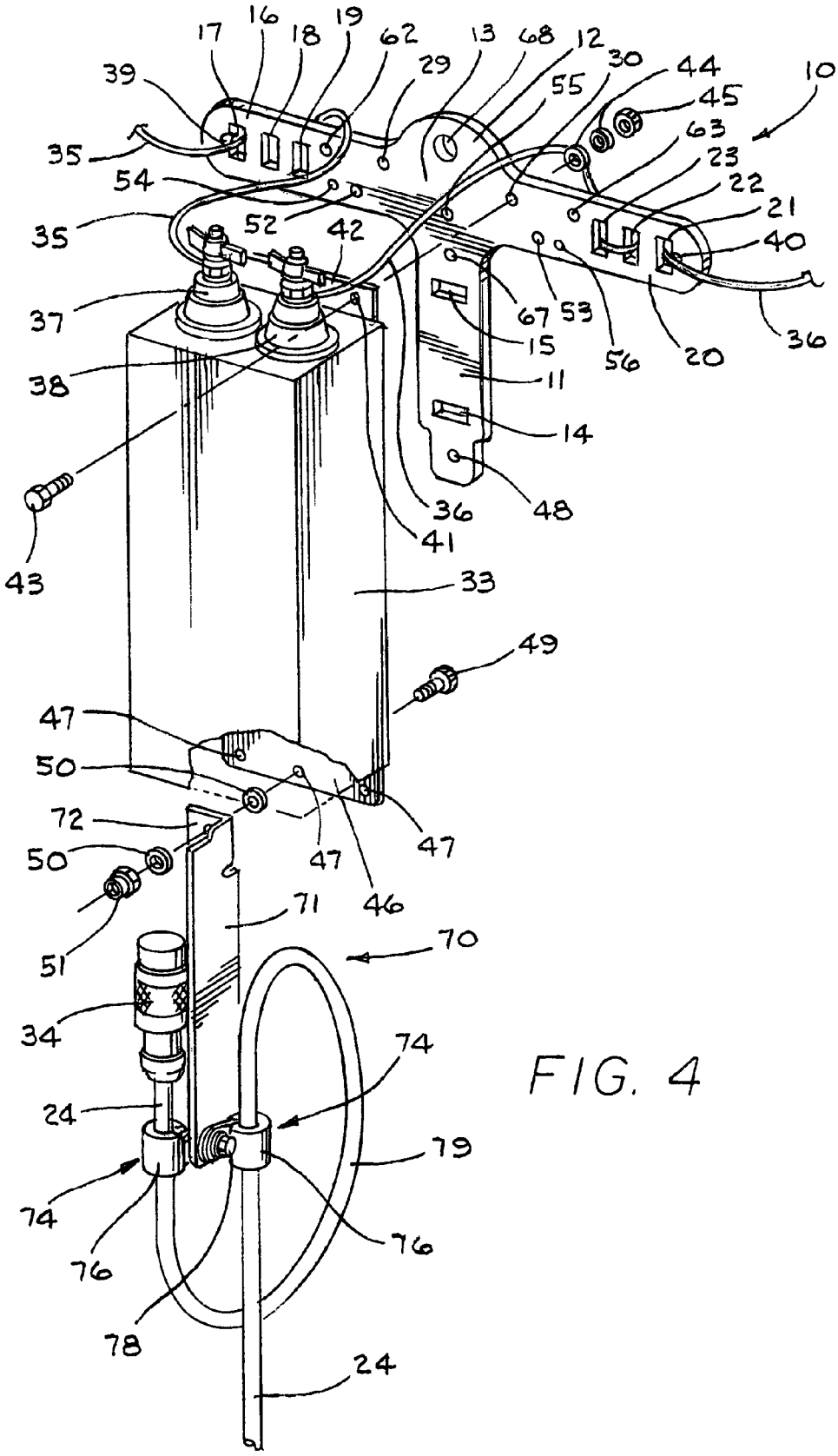
FIG. 4 is an exploded perspective of the manner in which the feedpoint support unit and the strain relief bracket may be utilized with a coax balun feed.

As shown in FIG. 4, oftentimes it is desirable to provide a balun 33 in the antenna system. In these instances, through coupling 34, the coaxial cable 24 is connected to the balun 33 and wires 35 and 36 may extend from terminals 37 and 38, respectively, to be received by support unit 10. Wire 35 may be received through slots 17, 18, and 19, and wire 36 may be received through slots 21, 22, and 23 as previously described with respect to lines 31 and 32. It is noted that slots 17 and 21 can be provided with notches 39 and 40, respectively, so that when the lines are in the form of wires 35 and 36, possible abrading of the wires 35 and 36 is minimized.

Balun 33 is conveniently carried by support unit 10, and to that end, apertures 29 and 30 can be appropriately spaced to match similar apertures 41 (one shown) in the upper mounting flange 42 of one size of a conventional balun 33. Fastening assemblies (one shown), including a bolt 43, washers 44, and nut 45, can be received at apertures 41 and apertures 29 and 30 to attach balun 33 to support unit 10. The bottom of balun 33 is also provided with a mounting flange 46 having a plurality of holes 47 therein. One of the holes 47 can be aligned with an aperture 48 in base 11 of support unit 10, and a fastening assembly including a bolt 49, washers 50, and nut 51 may be used to connect the bottom of balun 33 to support unit 10.

Although apertures 29 and 30 are spaced to match the spacing of similar apertures in one size of a balun 33, there are other sizes of baluns (not shown) which have differently spaced mounting apertures. So that support unit 10 may be universally used to carry these baluns of other sizes, differently spaced apertures 52 and 53 may be provided. Even larger baluns may be mounted to unit 10 by utilizing apertures 54, 55, and 56.

Figure 5:
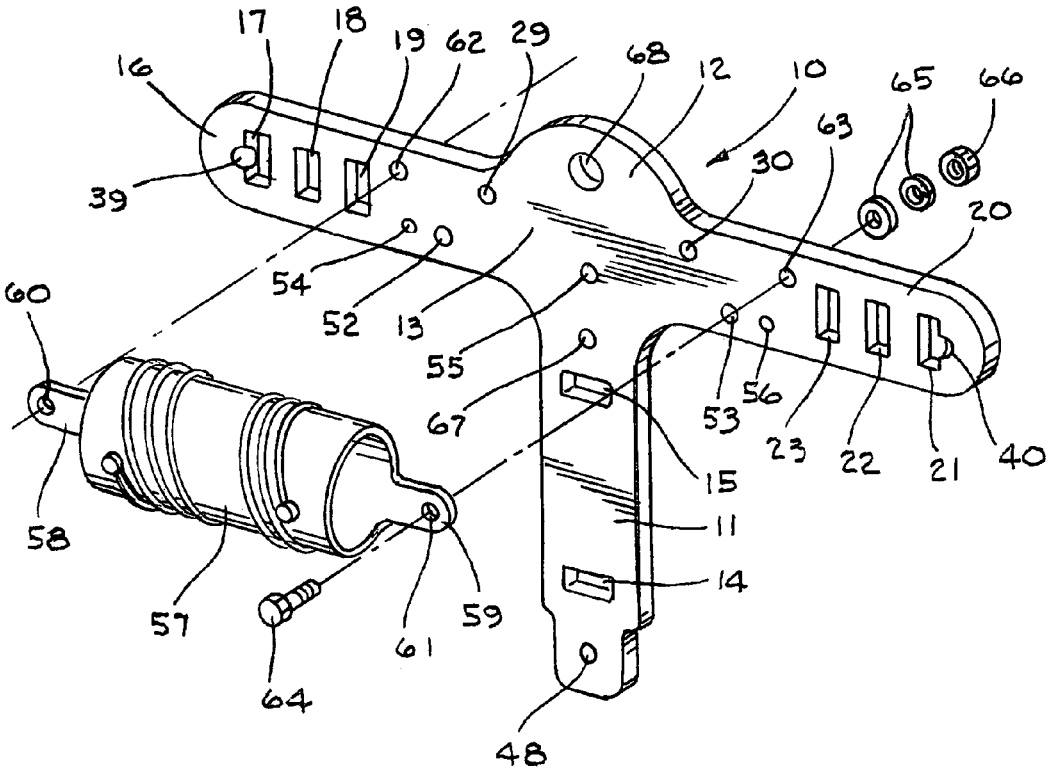
FIG. 5 is an exploded perspective view showing the manner in which the feedpoint support unit may carry a coil.

FIG. 5 depicts the manner in which a conventional coil 57 may be carried by support unit 10. Coil 57 is shown as having mounting ears 58 and 59 having holes 60 and 61, respectively, therein. Holes 60 and 61 are aligned with apertures 62 and 63, respectively, in support unit 10 so that the coil 57 can be attached to unit 10 by fastening assemblies (one shown) which include a bolt 64, washers 65, and a nut 66. A coil of a different size can be vertically oriented and mounted to support unit 10 using vertically spaced apertures 67 and 48.

Support unit 10 and the other antenna components may be suspended at a desired height by a messenger line (not shown) which can be fed through aperture 68 in head 12 of unit 11. The ends of the messenger line may then be affixed to an appropriate structure, and the antenna is suspended at the desired height. Alternatively, support unit 10 can be attached to appropriate structures by extending a fastener through aperture 68 to attach the unit 10 at the desired height.

Support unit 10 is also adapted to carry a strain relief bracket generally indicated by the numeral 70. Bracket 70 includes an elongate, generally rectangular plate 71 which has a tab 72 formed near one end thereof and extending laterally therefrom. Tab 72 is provided with an aperture 73 so that a fastening assembly (not shown) may be received therethrough, and through aperture 48 in base 11 of support unit 10 to attach bracket 70 to unit 10 as shown in FIG. 3. When other antenna accessories are utilized, such as balun 33, the same fastening assembly that attaches balun 33 to support unit 10 may be utilized to attach bracket 70 to unit 10 as shown in FIG. 4.

The other end of plate 71 carries a pair of wire holders generally indicated by the numeral 74. Each wire holder 74 includes a metallic strip 75, which is covered by a resilient sleeve or grip member 76. The ends of strips 75 extend outside of sleeves 76 to form mounting tabs 77. Tabs 77 are attached to the bottom end of plate 71 as by a fastening assembly 78 in such a manner that one grip member 76 is on one side of plate 71 and the other grip member 76 is on the other side of plate 71. As shown, the grip members 76 are also laterally offset from each other.

Whether coaxial cable 24 is attached via coupling 34 to the lead wires 25, 26 (FIG. 3), to balun 33 (FIG. 4), or to any other item, it is desired to take all strain off of coupling 34 to make certain that the connection is maintained secure. As shown in FIGS. 3 and 4, bracket 70 accomplishes that function. The cable 24 coming from a source is first positioned through one of the grip members 76, then a loop 79 is formed in cable 24, and it is extended through the other grip member 76. Fastening assembly 74 may then be tightened which not only attaches wire holders 73 to plate 71, but which also tightens the grip members 76 onto the cable 24 so that the cable 24 cannot slide therethrough. This is accomplished as the strips 75 are tensioned through the resilient sleeves 76, which can be made of a rubber or like material. Thus, if tension is placed on cable 24 from below antenna 10, such tension or strain is not extended to coupling 34 because the loop 79 between the grip members 76 can never be under tension.

In view of the forgoing, it should be evident that a feedpoint support unit and strain relief system constructed as described herein substantially improves the art and otherwise accomplishes the objects of the present invention.

What is claimed is:

1. An antenna comprising a feedpoint support plate, a feed line extending from a source and carried by said plate, a bracket carried by said plate, and a strain relief device carried by said bracket between the source of the feed line and said plate, said device including a first grip member and a second grip member, said feed line being connected to each said grip member with a loop being formed in said feed line between said first and second grip members.

2. The antenna of claim 1 wherein each said grip member includes a metallic strip and a resilient sleeve on said strip.

3. The antenna of claim 2 wherein a portion of each strip protrudes out of each side of said sleeve to form tabs.

4. The antenna of claim 3 further comprising means to attach said tabs to said bracket so that said sleeves grip said feed line.

5. The antenna of claim 1 wherein said first grip member is adjacent to the source of the feed line and said second grip member is adjacent to said plate.

6. The antenna of claim 1 further comprising a balun carried by said plate, said feed line being connected to said balun and said balun being connected to dipole lines.

7. The antenna of claim 6 wherein said first grip member is adjacent to the source of the feed line and said second grip member is adjacent to said balun.

8. The antenna of claim 1 further comprising a coil carried by said plate.

9. An antenna comprising a feedpoint support plate, means to carry a feed line on said plate, means permitting connection between said feed line and dipole lines, and means for selectively carrying a balun on said plate between said feed line and said dipole lines.

10. The antenna of claim 9 further means to carry a strain relief bracket.

11. The antenna of claim 10 wherein said bracket carries grip members which engage said feed line.

12. The antenna of claim 11 wherein each said grip member includes a metallic strip and a resilient sleeve on said strip.

13. The antenna of claim 12 wherein a portion of each strip protrudes out of each side of said sleeve to form tabs.

14. The antenna of claim 13 further comprising means to attach said tabs to said bracket so that said sleeves grip said feed line.

15. The antenna of claim 9 wherein said balun is of a first size and further comprising means for selectively carrying a balun of a second size on said plate between said feed line and said dipole lines.

16. The antenna of claim 9 further comprising means for selectively carrying a coil on said plate.

17. An antenna comprising a feedpoint support plate, a feed line extending from source to said plate, means permitting connection between said feed line and dipole lines, means for selectively carrying a balun on said plate between said feed line and said dipole lines, a bracket carried by said plate, and a strain relief device carried by said bracket between the source of the feed line and said plate, said device including a first grip member and a second grip member, said feed line being connected to each said grip member with a loop being formed in said feed line between said first and second grip members.

18. The antenna of claim 17 wherein said balun is of a first size and further comprising means for selectively carrying a balun of a second size on said plate between said feed line and said dipole lines.

19. The antenna of claim 16 further comprising means for selectively carrying a coil on said plate.

* * * * *